United States Patent [19]

Tani et al.

[11] Patent Number: 4,628,720

[45] Date of Patent: Dec. 16, 1986

[54] METHOD OF PRODUCTION OF CYLINDRICAL BODY

[75] Inventors: Tatsuhiro Tani; Hiroyuki Nagasawa; Rokuro Kikuchi; Tosio Tomite; Hidemitsu Kobayashi, all of Katsuta, Japan

[73] Assignee: Hitachi, Ltd., Tokyo, Japan

[21] Appl. No.: 622,157

[22] Filed: Jun. 19, 1984

[30] Foreign Application Priority Data

Jun. 20, 1983 [JP] Japan ..... 58-109142

[51] Int. Cl.[4] ..... B21D 39/02

[52] U.S. Cl. ..... 72/368; 72/51

[58] Field of Search ..... 72/48, 51, 368, 356; 29/521; 228/136, 137

[56] References Cited

U.S. PATENT DOCUMENTS 1,213,684 1/1917 Osterholm ..... 29/521
2,883,738 4/1959 Morrow ..... 29/149.5 R
3,594,599 7/1971 West .

FOREIGN PATENT DOCUMENTS 509586 2/1957 Italy ..... 72/356
684735 12/1952 United Kingdom ..... 72/51

*Primary Examiner*—Lowell A. Larson
*Attorney, Agent, or Firm*—Antonelli, Terry & Wands

[57] ABSTRACT

A method of production of a cylindrical body from a sheet of steel formed at opposite sides with projections and cutouts complementary to each other. The method comprises the steps of rolling the sheet of steel and inserting the projections in the cutouts to provide a cylindrical blank, and compressing at least one of inner and outer peripheral surfaces of the cylindrical blank in a radial direction to reduce the thickness of the cylindrical blank and to stretch a portion of the cylindrical blank in an axial direction whereby the projections inserted in the cutouts can be brought into intimate contact with each other at jointed portions.

4 Claims, 11 Drawing Figures

METHOD OF PRODUCTION OF CYLINDRICAL BODY

BACKGROUND OF THE INVENTION (1) Field of the Invention

This invention relates to a method of production of cylindrical bodies, and more particularly it is concerned with a method of production of a cylindrical body suitable for use as a yoke of a starter motor or other dynamoelectric machines.

(2) Description of the Prior Art

A starter motor usually used for starting an internal combustion engine is described, for example, in U.S. Pat. No. 3,594,599, in which a yoke in the form of a cylindrical body formed of iron has secured to its inner peripheral surface poles which include permanent magnets and field coils, and an armature core is located adjacent inner peripheral surfaces of the poles. The cylindrical body serving as the yoke has hitherto been produced by one of the following two methods. In one method, a sheet of iron is cut into predetermined lengths which are each rounded into an annular shape and joined by welding at ends abutted against each other to provide cylindrical bodies of a desired size. In the other method, a tubular blank formed of steel is cut into predetermined lengths to provide cylindrical bodies of a desired size. However, these two methods of the prior art are not without disadvantages. The method relying on welding for producing yokes would require a correction of the shape because the cylindrical bodies produced would undergo thermal deformation. Also, a problem would be raised that the influences of heat might cause a reduction in magnetic characteristics, thereby adversely affecting the performance of the motor. When a tubular steel blank is used as material, the problem of high cost would be raised because a solid-drawn steel pipe is high in cost and the tubular steel blank would have to be prepared specially for the purpose, depending on the dimension of the outer diameter.

To obviate the aforesaid disadvantages of the prior art, proposals have been made to use a method wherein a sheet of metal cut in a predetermined size is formed at opposite sides with a protuberance and a groove which are complementary to each other and subjected to rolling to form same into a cylindrical shape, and the protuberance and groove of the rolled sheet are interfitted to provide a cylindrical body of the desired dimensions. Since the protuberance is merely fitted in the groove when the sheet of metal is formed into a cylindrical shape, it is inevitable that gaps are formed between the protuberance and groove when one is fitted in the other. Formation of the gaps causes an increase in reluctance and has adverse effects on the magnetic characteristics.

SUMMARY OF THE INVENTION (1) Object of the Invention

This invention has been developed for the purpose of obviating the aforesaid disadvantages of the prior art. Accordingly, the invention has as its object the provision of a method of production of a cylindrical body which enables the cylindrical body to be produced with no gaps at jointed portions, at low cost and with a high degree of productivity from a sheet of metal.

(2) Statement of the Invention

The outstanding characteristic of the invention enabling the aforesaid object to be accomplished is that a sheet of metal severed from a strip of metal and formed at opposite sides with projections and cutouts adapted to fit one in the other is rolled and formed into a cylindrical blank by inserting the projections in the respective cutouts, and the cylindrical blank has at least one of inner and outer peripheral surfaces stretched in an axial direction by pressure applied thereto whereby the projections and cutouts can be brought into intimate contact with each other at jointed portions.

DESCRIPTION OF THE PREFERRED EMBODIMENTS

The preferred embodiments of the invention will now be described by referring to the accompanying drawings.

Figure 1:
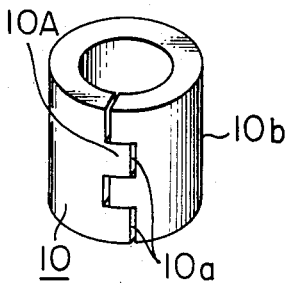
FIG. 1 is a perspective view of a cylindrical blank of metal used in the invention for providing a cylindrical body.
Figure 2:
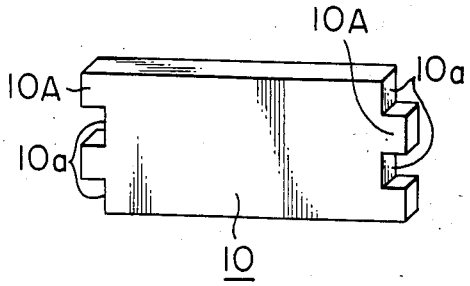
FIG. 2 is a developed view of the cylindrical blank of metal shown in FIG. 1.

FIG. 1 shows a cylindrical blank **10*b* formed of a sheet 10 of magnetic material suitable for producing a yoke of a starter motor, for example. FIG. 2 is a developed view of the cylindrical blank 10*b* shown in FIG. 1 as being formed of the sheet 10 of magnetic material, in which the sheet 10 is shown as being formed at opposite sides with projections 10A and cutouts 10*a* adapted to fit one in the other when the sheet 10 is rolled and the opposite sides are brought into abutting engagement with each other, to provide the cylindrical blank 10*b***.

Figure 3:
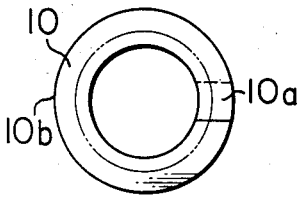
FIG. 3 is a top plan view of the cylindrical blank of metal shown in FIG. 1.
Figure 4:
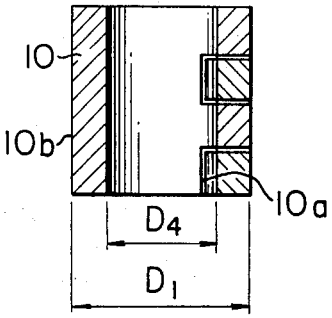
FIG. 4 is a substantially central vertical sectional view of the cylindrical blank shown in FIG. 3.

The sheet 10 of magnetic material for providing the cylindrical blank **10*b* of magnetic material is obtained by cutting a strip of steel material into predetermined lengths with the cutouts 10*a* and projections 10A formed on the ends of each length and subjecting each of them to rolling or other suitable treatment to provide the cylindrical blank 10*b* by inserting the projections 10A into the cutouts 10*a*. FIGS. 3 and 4 are a top plan view and a substantially central vertical sectional view of the cylindrical blank 10b**.

Figure 5:
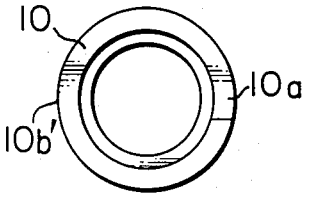
FIG. 5 is a top plan view of the cylindrical body produced by the method comprising one embodiment of the invention, obtained by processing the cylindrical blank of metal shown in FIG. 1 through the step shown in FIGS. 3 and 4.
Figure 6:
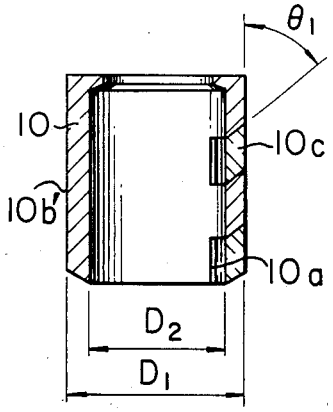
FIG. 6 is a substantially central vertical sectional view of the cylindrical body shown in FIG. 5.

The cylindrical blank 10b thus obtained is restrained by a metal mold which is fitted to the forward end and the entire outer peripheral surface and the inner peripheral surface is pressed by means of a punch of a diameter slightly larger than the inner diameter of the cylindrical blank 10b, to compress the cylindrical blank 10b in the direction of the thickness thereof to cause deformation to occur. Since the cylindrical blank 10b is restrained at the forward end and the entire outer peripheral surface, the inner peripheral surface of the cylindrical blank 10b is stretched axially rearwardly until the thickness of the cylindrical blank 10b is reduced to a predetermined level. Thus, a cylindrical body 10b' of the predetermined dimensions shown in a top plan view in FIG. 5 and in a substantially central vertical sectional view in FIG. 6 is obtained.

When the outer diameter and the inner diameter of the cylindrical body 10b' are designated by $D_1$ and $D_2$ respectively, the inner diameter $D_4$ of the cylindrical blank 10b is made smaller than the inner diameter $D_2$ of the cylindrical body 10b', and the inner peripheral surface of the cylindrical blank 10b is compressed as aforesaid to cause deformation to occur to increase the inner diameter from $D_4$ to $D_2$. As a result, the projections 10A inserted in the cutouts 10a and snugly fit therein are brought into intimate contact with each other at jointed portions 10c. At this time, the inner peripheral surface of the cylindrical blank 10b shifts relative to the punch and is stretched axially. By keeping an angle $\theta_1$ formed by each of the jointed portions 10c and the outer peripheral surface of the cylindrical body 10b' at a level at least below 90 degrees, it is possible to prevent the movement of the jointed portions 10c in a radial direction, so that the projections 10A and cutouts 10a can be kept in intimate contact with each other at the jointed portions 10c to allow the cylindrical body 10b' to keep its integrity by resisting an external force exerted thereon. A flange is formed at the forward end of the cylindrical body 10b' because the presence of the mold makes it impossible to fully compress the inner peripheral surface. However, the flange may be removed by any known method, if so desired.

In the cylindrical body 10b' produced as described hereinabove, the projections 10A and cutouts 10a are kept in intimate contact with each other at the jointed portions 10c. This enables the cylindrical body 10b' to be provided with the same precision finish and rigidity as are provided to a hollow member (seamless pipe) prepared separately. The method according to the invention enables a material to be used which cannot be used for producing the hollow member. For example, when the cylindrical body is intended for use as an outer magnetic frame of a permanent magnet type direct current electric motor, a material of high magnetic characteristics can be used. This is conducive to improved performance of the motor.

Figure 7:
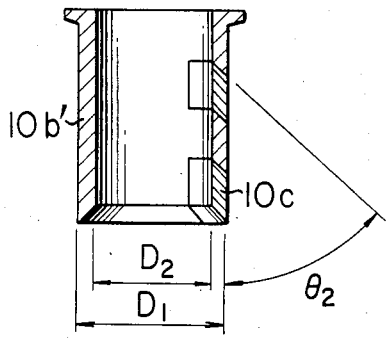
FIG. 7 is a substantially central vertical sectional view of the cylindrical body produced by the method comprising another embodiment of the invention.

FIG. 7 shows another embodiment of the invention for producing a cylindrical body 10b' of desired dimensions by compressing the cylindrical blank 10b with a metal mold. In the embodiment shown in FIG. 7, the sheet 10 of metal is rolled to obtain a cylindrical blank 10b in which the inner diameter $D_2$ is sized to have a desired value for the inner diameter of the cylindrical body and the outer diameter $D_0$ is greater than a desired value for the outer diameter $D_1$ of the cylindrical body, so that the outer diameter $D_0$ is reduced to the outer diameter $D_1$ by compression. In this embodiment, the forward end and the inner peripheral surface of the cylindrical blank are restrained by a mold and the outer peripheral surface is pressed from an axial direction by means of a cylindrical metal mold, to thereby provide a cylindrical body of the predetermined outer diameter $D_1$. Downward movement of the cylindrical metal mold reduces the thickness of the cylindrical blank and causes the outer peripheral surface to stretch axially rearwardly, to bring the projections inserted in the cutouts into intimate contact with each other at the jointed portions 10c.

Figure 8:
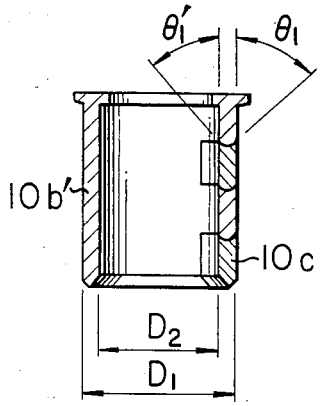
FIG. 8 is a substantially central vertical sectional view of the cylindrical body produced by the method comprising still another embodiment of the invention.

FIG. 8 shows still another embodiment of the invention for producing a cylindrical body 10b'. In this embodiment, the cylindrical blank 10b obtained by rolling the sheet 10 which is pressed from an axial direction both at the inner peripheral surface and outer peripheral surface with a metal mold. In this case, a central portion of the thickness of the cylindrical blank 10b between the inner peripheral surface and outer peripheral surface is stretched axially rearwardly as the cylindrical blank 10b is compressed, so that the projections inserted in the cutouts are brought into intimate contact with each other at the jointed portions 10c.

Figure 9:
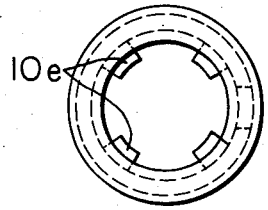
FIG. 9 is a top plan view of the cylindrical body produced by the method comprising a further embodiment of the invention.
Figure 10:
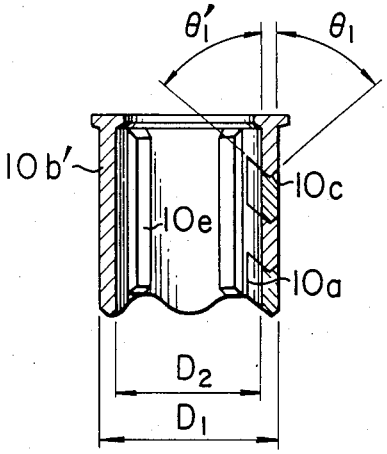
FIG. 10 is a sectional view of the cylindrical body shown in FIG. 9, showing the essential portions thereof.

FIGS. 9 and 10 show a further embodiment of the invention for producing a cylindrical body 10b'. In this embodiment, the sheet 10 of metal is rolled into a cylindrical blank 10b in which the outer diameter $D_0$ is larger than a desired value for the outer diameter $D_1$ of the cylindrical body 10b and the inner diameter $D_4$ is smaller than a desired value for the inner diameter $D_2$ of the cylindrical body, so that the cylindrical blank 10b is subjected to deformation by compression to obtain the inner diameter $D_2$ and the outer diameter $D_1$ of the desired values while ribs 10e parallel to each other are formed on the inner peripheral surface and extend in an axial direction. The cylindrical body 10b' obtained by the embodiment of the invention shown in FIGS. 9 and 10 has particular utility as an outer magnetic frame of a permanent magnet type direct current electric motor. In this application, a magnetic loss between the cylindrical body 10b' serving as an outer magnetic frame and the ribs 10e serving as interpoles does not occur, which improves magnetic characteristics. Also, the jointed portions 10c formed by the projections inserted in the cutouts are deformed, so that the angle $\theta_1'$ formed by each of the jointed portions 10c and the inner peripheral surface of the cylindrical body 10b' and the angle $\theta_1$ formed by each of the jointed portions 10c and the outer peripheral surface of the cylindrical body 10b' can be kept at least below 90 degrees.

Figure 11:
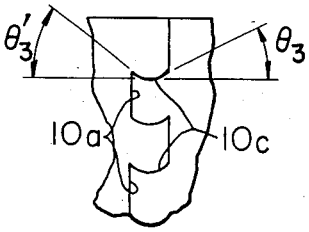
FIG. 11 is a side view of the cylindrical body shown in FIGS. 9 and 10, showing their essential portions.

FIG. 11 shows the camber angles $\theta_3$ and $\theta_3'$ in a circumferential direction of the jointed portions 10c as viewed from one side after the cylindrical blank 10b is deformed into the cylindrical body 10b' by compression. In the figure, it will be seen that the camber angles $\theta_3$ and $\theta_3'$ at least exceed 0 degrees, so that the projections inserted in the cutouts are brought into contact with each other at the jointed portions 10c with increased intimacy and the reliability of a joint provided by the jointed portions 10c is improved. By using the cylindrical body 10b' produced by the embodiment shown in FIGS. 9 and 10, it is possible to greatly increase the dimensional precision, rigidity and performance of the prior art in which the outer magnetic frame and the interpoles are joined together by welding.

The provision of a plurality of cutouts 10*a* for inserting the projections 10A facilitates rounding the sheet 10 of metal.

What is claimed is:

1. A method of production of a cylindrical body comprising the steps of:

preparing a sheet of metal formed at opposite sides thereof with portions complementary to each other and adapted to fit one in the other;

rolling said metal sheet and fitting said complementary portions one in the other to form a cylindrical blank; and stretching at least one of inner and outer peripheral surfaces of the cylindrical blank in an axial direction while axially restraining at least a portion of said cylindrical blank and radially compressing a wall of said cylindrical blank in a manner to reduce thickness of the cylindrical blank over an entire periphery of the latter, thereby forming the cylindrical body in which said complementary portions are joined together in an intimately contacted manner by said stretching and compressing operation with at least a part of the contact surfaces between said complementary portions being defomred to have a predetermined taper angle below 90° with respect to said axial direction.

2. A method of production of a cylindrical body as claimed in claim 1, wherein said stretching and compressing step includes the step of pressing and deforming an inner peripheral surface of the cylindrical blank while restraining an outer peripheral surface of the latter with a metal mold, thereby making said jointed complementary portions inclined in the direction in which the latter are pressed.

3. A method of production of a cylindrical body as claimed in claim 1, wherein said stretching and compressing step includes the step of pressing and deforming an outer peripheral surface of the cylindrical blank while restraining an inner peripheral surface of the latter with a metal mold, thereby making said jointed complemetary portions inclined in the direction in which the latter are pressed.

4. A method of production of a cylindrical body as claimed in claim 1, wherein said stretching and compressing step includes the step of pressing and deforming inner and outer peripheral surfaces of the cylindrical block simultaneously with metal molds, thereby making said jointed complementary portions inclined in the direction in which the latter are pressed.

* * * * *